United States Patent [19]

Zboralski

[11] 4,385,551

[45] May 31, 1983

[54] FUME HOOD WITH SASH LOCK

[75] Inventor: Jon A. Zboralski, Manitowoc, Wis.

[73] Assignee: Hamilton Industries, Inc., Two Rivers, Wis.

[21] Appl. No.: 189,464

[22] Filed: Sep. 22, 1980

[51] Int. Cl.[3] ..... F23J 11/00

[52] U.S. Cl. ..... 98/115 LH; 49/449; 292/216; 292/DIG. 21; 292/DIG. 65; 312/215

[58] Field of Search ..... 98/115 R, 115 LH; 49/68, 449; 292/213, 216, DIG. 21, DIG. 65; 312/215, 217, 218, 221; 220/346, 347; 137/636

[56] References Cited

U.S. PATENT DOCUMENTS

| | | | |
|---|---|---|---|
| 1,013,444 | 1/1912 | Robbins | 312/215 |
| 1,481,878 | 1/1924 | Palmer | 312/215 |
| 2,274,917 | 3/1942 | Carlson et al. | 137/636 |
| 3,025,780 | 3/1962 | Russell | 98/115 LH |
| 3,401,998 | 9/1968 | Evans et al. | 312/215 |
| 3,726,206 | 4/1973 | Worick, Jr. | 98/115 LH |
| 3,941,441 | 3/1976 | Scheerhorn | 312/215 |
| 4,249,563 | 2/1981 | Shaw | 137/636 |

FOREIGN PATENT DOCUMENTS

| | | | |
|---|---|---|---|
| 14191 | 8/1980 | European Pat. Off. | 312/221 |
| 1111959 | 7/1961 | Fed. Rep. of Germany | 292/213 |
| 1122296 | 1/1962 | Fed. Rep. of Germany LH | 98/115 |
| 12687 | of 1911 | United Kingdom | 137/636 |

*Primary Examiner*—Albert J. Makay
*Assistant Examiner*—Harold Joyce
*Attorney, Agent, or Firm*—Tilton, Fallon, Lungmus & Chestnut

[57] ABSTRACT

A laboratory fume hood with at least two vertically movable sashes that are operatively coupled together by a sash lock that prevents both of the sashes from being opened at the same time. Opening of one sash automatically flips a pivoted lock into locking engagement with the other sash. Thus, one of the sashes must be closed before the other can be opened. This prevents the excessive waste of heated or cooled room air being sucked out through the fume hood.

15 Claims, 4 Drawing Figures

FUME HOOD WITH SASH LOCK

BACKGROUND

Laboratory fume hoods are generally classified into two types. One type is the horizontal sash fume hood, such as shown in U.S. Pat. No. 2,715,359; and the other type is the vertical sash fume hood, such as shown in U.S. Pat. No. 3,747,504.

Horizontal sash fume hoods have a distinct advantage in that the two sliding doors, such as 26 and 26' in FIG. 1 of U.S. Pat. No. 2,715,359, prevent all the sashes from being open at the same time. Thus, a wide horizontal workbench area can be provided for laboratory experiments to be set up, but only the immediate area being used is open for operator access. This conserves the heated and cooled room air and prevents excess room air from being sucked out through the fume hood.

In a single vertical sash fume hood, such as in U.S. Pat. No. 3,747,504, an access opening to the entire work area is completely open when the sash is raised. This can cause excessive loss of room air since generally only a portion of the laboratory bench is used at one time.

To cut down loss of heated and cooled room air, a proposal has been made for a hybrid type fume hood that includes both a vertical and a horizontal sash as disclosed in U.S. Pat. No. 4,142,458. However, such a system is more complicated because it requires a complete horizontal tracking and roller system, as well as a vertical tracking system for the vertical sash. Since the vertical sash and horizontal sash are of different sizes and constructions and are not interchangeable, the cost of such a hybrid sash system would be much more than either a conventional vertical sash or horizontal sash type fume hood.

SUMMARY OF THE INVENTION

The present invention overcomes the problems mentioned above by providing two or more side by side vertical sashes, and a sash lock that operatively couples a pair of such sashes so that one sash of the pair must be closed before the other sash of the pair can be opened. Both sashes can move in a simple parallel track system.

THE DRAWINGS

DETAILED DESCRIPTION

Figure 1:
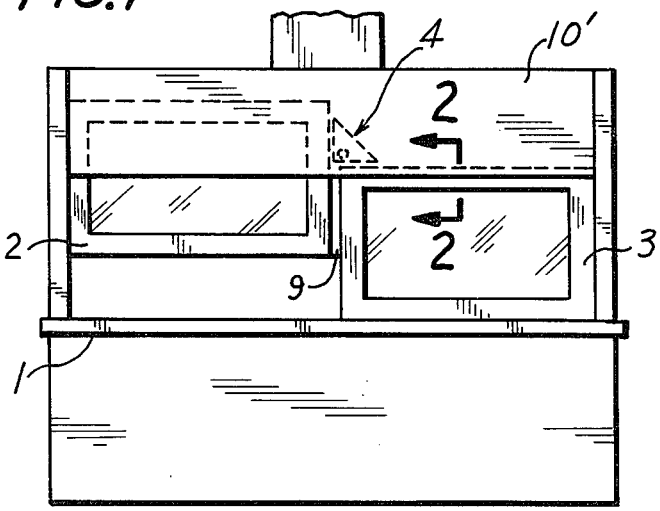
FIG. 1 is a front elevational view of the fume hood showing one sash partially raised.

In FIG. 1, a vertical sash type fume hood is shown which has a workbench area 1 and a pair of vertically movable sashes 2 and 3. These sashes can include an outer frame member and a transparent central panel. In this figure, the left sash 2 is partially open, causing a triangularly shaped sash lock 4 to be positioned as shown in dotted line. This sash lock 4 is in a position to contact an upper end of right sash 3 and prevent its opening so long as sash 2 is in an open position. In order to open right sash 3, the left sash 2 must be lowered to a closed position so that the right side of sash 2 no longer prevents the pivotal movement of sash lock 4. Thus, only one sash at a time can be opened and this greatly reduces the loss of heated or cooled room air being sucked out through the fume hood. Both sashes can be of approximately the same shape and size and open and close in a parallel vertical track system.

Figure 3:
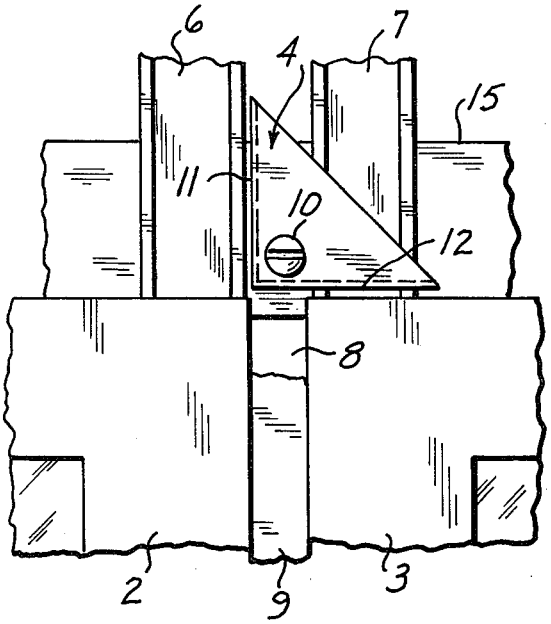
FIG. 3 is an enlarged fragmentary view of the sash lock showing both sashes closed.

In the enlarged fragmentary view of FIG. 3, the sashes 2 and 3 are in a closed position, having been moved downwardly in their respective tracks 6 and 7. As seen in FIG. 3, there is a gap 8 between the inner edges of sashes 2 and 3, and this gap is closed by shield member 9 connected to one of the sashes, but not to the other. As shown in FIG. 1, shield 9 slides upwardly with sash 2 in front of sash lock 4. To more clearly expose sash lock 4 in FIG. 3, the front panel 10' of the fume hood has been removed from the view shown in FIG. 1.

Figure 4:
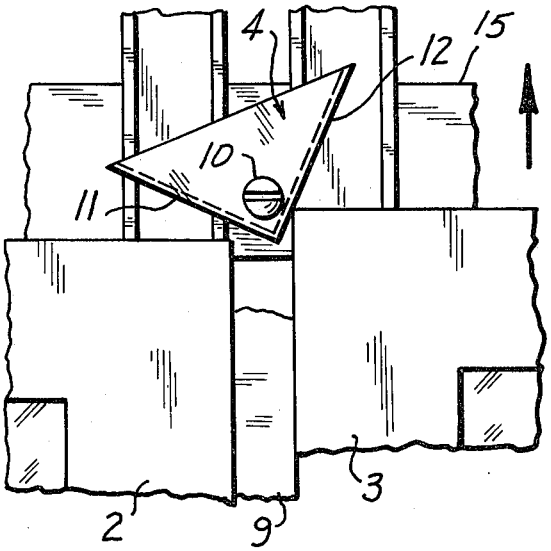
FIG. 4 is a fragmentary view similar to FIG. 3, but showing the right sash being opened.

With both sashes at their lowermost point as shown in FIG. 3, either sash (but not both) can be raised. If the sash 2 at the left is raised, the sash lock 4 remains in the position shown in FIG. 3 and the right edge of sash 2 is positioned alongside sash lock 4 as shown in FIG. 1. If the right sash is raised as shown in FIG. 4, the upward movement of sash 3 pivotally flips sash lock 4 about pivot bolt 10 so that an abutment surface 11 is positioned over an upper edge surface of sash 2. When in the position shown in FIG. 3, an abutment surface 12 overlies the upper edge of panel 3. The pivotally flipping motion of sash lock 4 occurs because the pivot bolt 10 is located directly above gap 8 between panels 2 and 3. When sash lock 4 is contacted during upward motion of either panel 2 or 3, there is a mechanical swivel moment about pivot 10 causing the flipping action. To an operator, the concealed sash lock actuation is not readily apparent. All the operator knows is that only one sash can be raised at a time.

The enlarged sectional view in FIG. 3 shows the details of the sash lock which is secured to a cross beam 15 by a bolt 10. Bolt 10 is anchored to cross beam 15 by nuts 16 and 17 which have washers 18 and 19 next to beam 15. Thus, bolt 10, when tightened down with nuts 16 and 17, cannot turn relative to beam 15. An inner panel 28 extends above the cross beam 15 to separate the raised portions of the sashes from direct contact with interior of the hood.

Figure 2:
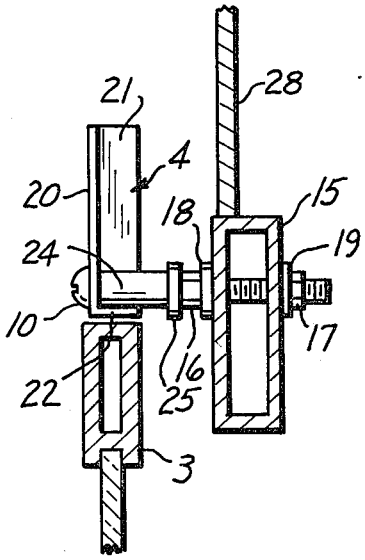
FIG. 2 is an enlarged sectional view taken along line 2—2 of FIG. 1.

The sash lock designated generally at 4 includes the bolt 10, its corresponding nuts, as well as a stop membeer in the general form of a right triangle that has a supporting back 20 with flanges 21 and 22. The outer surfaces of flanges 21 and 22 are the abutment surfaces 11 and 12 respectively. Secured at a right angle corner area of the stop member is a bushing 24 which can be welded to the stop member so bushing 24 moves with the triangular stop member as the stop member pivots on bolt 10. The spacing between the head of bolt 10 and slide washer 25 is adjusted so that the stop member portion of sash lock 4 is free to pivotally swing, but is sufficiently confined to align with the top edges of the sashes. In the position shown in FIG. 2, flange 22 is located directly above sash 3 and prevents its opening.

In the drawings, a single pair of vertically slidable sashes has been disclosed, but it is understood that the access opening to the hood could be closed by several pairs of vertically slidable sashes, with the sashes of each pair being operatively coupled by the sash lock described above. Also, the sashes and sash lock described can be used with fume hoods, whether or not the fume hood has an auxiliary air source to bring outside air into the room adjacent the access opening.

In the above description, a specific example has been used to describe the invention. However, it is understood by those skilled in the art that certain modifications can be made to this example without departing from the spirit and scope of the invention.

I claim:

1. A fume hood comprising: a cabinet with an access opening; a plurality of sashes to open and close portions of the access opening; and a sash lock operatively coupling at least two sashes with a structure that unlocks one of the sashes for opening only when the other sash is locked against opening for controlling airflow through the hood; the sash lock being pivotally connected to the fume hood and including a stop member having abutment surfaces facing in different directions, said stop member being pivotally movable to position the abutment surfaces for selectively locking one of the sashes against opening while permitting the other sash to open, whereby all of the sashes cannot be opened at the same time.

2. A fume hood as set forth in claim 1, wherein the abutment surfaces are at approximately right angles to each other.

3. A fume hood as set forth in claim 1, wherein the abutment surfaces are flanges connected to a supporting back.

4. A fume hood as set forth in claim 1, wherein the stop member is secured to a pivot shank.

5. A fume hood as set forth in claim 4, wherein the pivot shank is a hollow bushing fitting over a spindle secured to the fume hood.

6. A fume hood as set forth in claim 5, wherein the spindle is a bolt or the like.

7. A fume hood as set forth in claim 1, wherein the abutment surfaces of the stop member meet a corner, and the pivot is in an area adjacent such corner of the stop member.

8. A fume hood as set forth in claim 7, wherein the stop member is in the general shape of a right triangle, with the pivot located in the right angle area of the stop member.

9. A fume hood as set forth in claim 1, wherein the sashes have upper edge portions, and the abutment surfaces engage these upper edge portions of the sashes to lock the sashes against opening.

10. A fume hood comprising: a cabinet with an access opening; a plurality of vertically movable sashes to open and close portions of the access opening and having upper edge portions; and a sash lock pivotally connected to the fume hood between two sashes; which sash lock has a pair of abutment surfaces facing in different directions; one of the abutment surfaces engaging an upper edge portion of one sash to lock it against opening when the other abutment surface s positioned alongside the other sash when such other sash is open.

11. A fume hood as set forth in claim 10, wherein the abutment surfaces are approximately at right angles to each other.

12. A fume hood as set forth in claim 10, wherein the sashes have portions that are horizontally spaced apart, and it is in this area that such sash lock is pivotally connected to the fume hood.

13. A cabinet having an access opening and a pair of adjacent vertically-movable sashes extending along substantially the same vertical plane for opening and closing portions of said access opening; said sashes having a pair of parallel side edge portions spaced laterally apart; and a sash lock in the form of a stop member pivotally mounted upon said cabinet for movement in the plane of said sashes about a pivot axis disposed above said access opening and between said sashes; said stop member having a pair of abutment surfaces facing in different directions; said stop member being pivotal into a first position wherein one of said abutment surfaces is shifted into a generally vertical position by the raising of one of said sashes and the other of said abutment surfaces blocks the raising of the other of said sashes, and a second position wherein said other of said abutment surfaces is shifted into a generally vertical position by the raising of the other of said sashes and said one abutment surface blocks the raising of said one sash, whereby, said sash lock allows only one sash to be raised at one time.

14. The cabinet of claim 13 in which each of said abutment surfaces is substantially planar.

15. The cabinet of claim 14 in which said planar abutment surfaces are disposed at substantially right angles to each other.

* * * * *